US008011851B1

(12) United States Patent
Crites

(10) Patent No.: US 8,011,851 B1
(45) Date of Patent: Sep. 6, 2011

(54) MANHOLE CUTTING AND REMOVING DEVICE

(76) Inventor: Michael Crites, Lima, OH (US)

( * ) Notice: Subject to any disclaimer, the term of this patent is extended or adjusted under 35 U.S.C. 154(b) by 255 days.

(21) Appl. No.: 12/583,322

(22) Filed: Aug. 19, 2009

Related U.S. Application Data

(63) Continuation-in-part of application No. 11/900,583, filed on Sep. 13, 2007, now Pat. No. 7,740,415.

(51) Int. Cl.
*E02D 29/12* (2006.01)

(52) U.S. Cl. ..... 404/94; 404/75; 404/83; 299/39.3

(58) Field of Classification Search ..... 404/75, 404/83, 94; 299/39.1, 39.3
See application file for complete search history.

(56) References Cited

U.S. PATENT DOCUMENTS

| | | | | |
|---|---|---|---|---|
| 3,297,353 | A * | 1/1967 | Carlson | 294/81.61 |
| 4,924,951 | A | 5/1990 | Paulson | |
| 4,968,101 | A | 11/1990 | Bossow | |
| 5,470,131 | A | 11/1995 | Nolan et al. | |
| 5,522,646 | A * | 6/1996 | Friedman et al. | 299/39.3 |
| 6,161,985 | A * | 12/2000 | Hinkle et al. | 404/26 |
| 6,536,987 | B2 | 3/2003 | Change | |
| 6,709,064 | B2 | 3/2004 | Nettek | |
| 6,755,481 | B2 | 6/2004 | Katsumoto | |
| 2011/0084540 | A1 * | 4/2011 | Cochran et al. | 299/18 |

* cited by examiner

*Primary Examiner* — Raymond Addie
(74) *Attorney, Agent, or Firm* — Harpman & Harpman

(57) ABSTRACT

A device to secure, cut and sequentially remove a manhole from a street environment. The manhole removing device is supported and rotatably driven hydraulically by a mobile operation equipment. A circular disk assembly has adjustable pavement cutters adjustably positioned from there within an inter-related manhole centering and a locking alignment and engagement plate assembly define a one-step cutting and removal of an existing manhole from the street for replacement.

13 Claims, 8 Drawing Sheets

MANHOLE CUTTING AND REMOVING DEVICE

This is a continuation in part application of Ser. No. 11/900,583, filed Sep. 13, 2007 now U.S. Pat. No. 7,740,415.

BACKGROUND OF THE INVENTION

1. Technical Field

This device relates to automated digging machines that have been developed to engage, cut and remove manholes found in street environments. Such machines typically cut the interior casing of the manhole in preparation for removal, repair and replacement due to changes in street elevations associated with resurfacing or repair and replacement.

2. Description of Prior Art

Prior art devices of this type have relied on a variety of cutting and removal devices, see for example U.S. Pat. Nos. 4,924,951, 4,968,101, 5,470,131, 6,536,987, 6,709,064 and 6,755,481.

U.S. Pat. No. 4,924,951 claims a manhole cutter for cutting a fixed diameter circular groove of a fixed depth around the surface of a manhole. The cutter is of a continuous ring design with spaced sections having cutting teeth elements.

A vertical asphalt and concrete milling device is illustrated in U.S. Pat. No. 4,968,101 having a large circular cutting drum with continuous teeth along the bottom edge.

In U.S. Pat. No. 5,470,131 a method and apparatus for cutting circular slots in pavements extending about a manhole casing is disclosed in which a self-propelled core cutting device has an open drum shaped cutting blade which is rotated by a hydraulic drive means to engage and cut the surface about an existing manhole.

U.S. Pat. No. 6,536,987 discloses a quick manhole/manhole construction method and related device in which a cutting unit is positioned within the manhole and the cuts using a circular saw for removal thereof.

U.S. Pat. No. 6,709,064 is directed towards a method and device for detaching or cutting an embedded manhole frame that positions a circular cutting saw blade within the manhole so as to cut from the inside the existing hole casing for removal.

U.S. Pat. No. 6,755,481 claims a method for cutting asphalt or concrete around a manhole using a circular offset cutting blade.

SUMMARY OF THE INVENTION

An automatic manhole removing tool for use with a mobile power take-off that cuts and removes a manhole assembly from a street surface for replacement. The tool self-centers and secures within the manhole using adjustable blade elements to cut a circular groove about the manhole and therein remove same. An adjustable manhole engagement assembly provides multiple adjustable engagement arm pairs that engage the manhole frame aligning the cutting tool within the interior casing of the manhole to be removed.

DETAILED DESCRIPTION OF THE INVENTION

Figure 1:
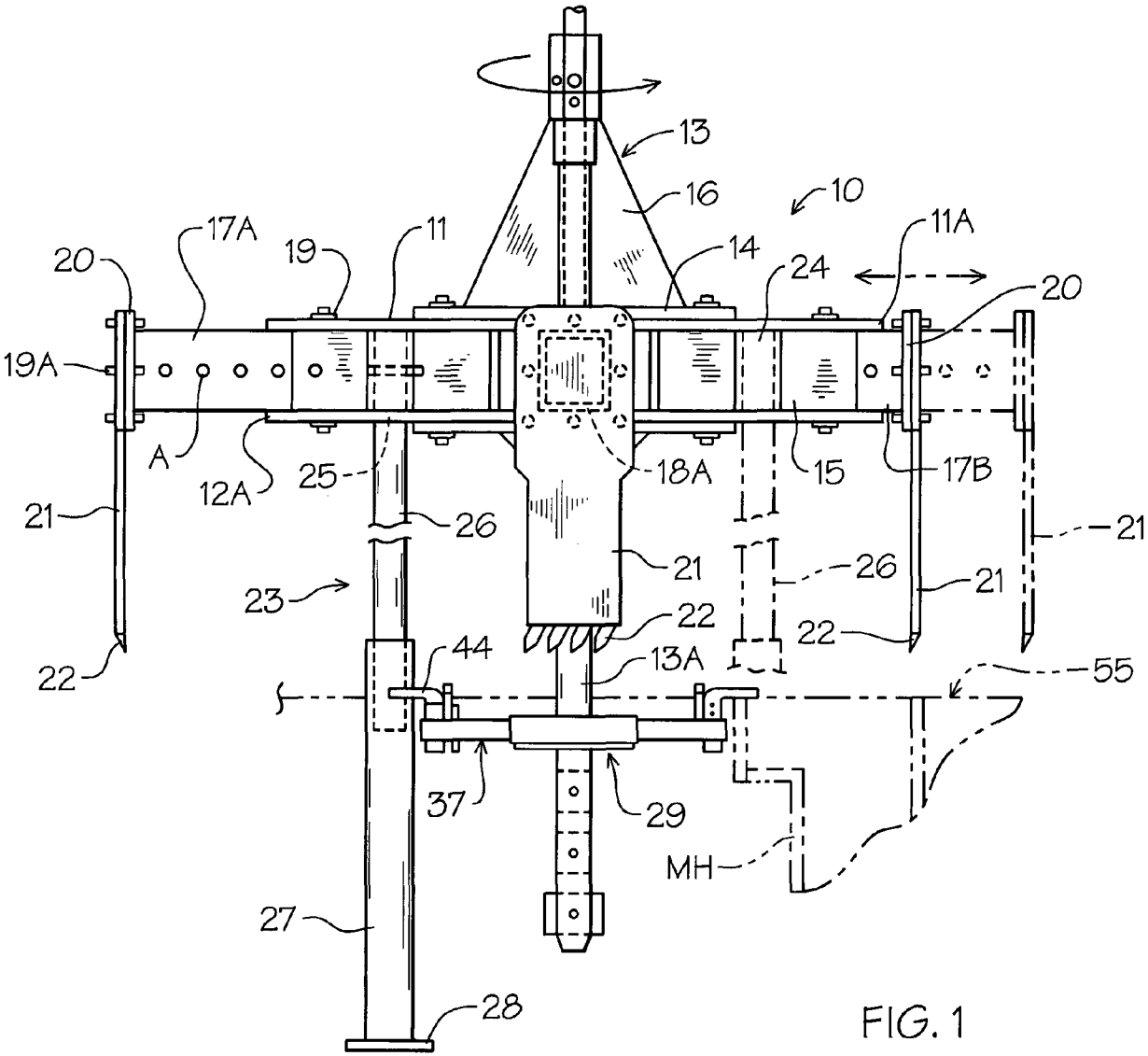
FIG. 1 is a side elevational view of the manhole removing device of the invention.

Referring to FIG. 1 of the drawings, an improved manhole removal tool 10 of the invention can be seen having a pair of vertically spaced and aligned main support frame disks 11 and 12 secured to a central drive shaft assembly 13. The upper disk 11 has a reinforced plate 14 with a plurality of interconnection and guide brackets 15 extending between and securing the support frame disks 11 and 12 together. Multiple reinforcement gussets 16 are welded to the reinforcement plate 14 and central drive shaft assembly 13. A drive and extraction shaft 13A extends from the shaft assembly 13. Pairs of oppositely disposed aligned cutting blade mounting arms 17A, 17B and 18A and 18B are slidably positioned between respective support frame disks 11 and 12 and the respective guide brackets 15. Each of the mounting arms 17A and 18B are of a tubular construction having a plurality of longitudinally spaced and transversely aligned adjustable adjustment apertures A therein with a pair of spaced corresponding apertures A1 in their respective upper and lower support frame disks 11 and 12. Locking nut and bolt assemblies 19 are secured therethrough providing for incremental longitudinal adjustment of each of the mounting arms 17A and 17B and 18A and 18B extending from the respective guide brackets 15 between support frame disks 11 and 12. Each of the mounting arms 17A and 17B and 18A and 18B have an apertured mounting flange 20 on the free end thereof.

Figure 4:
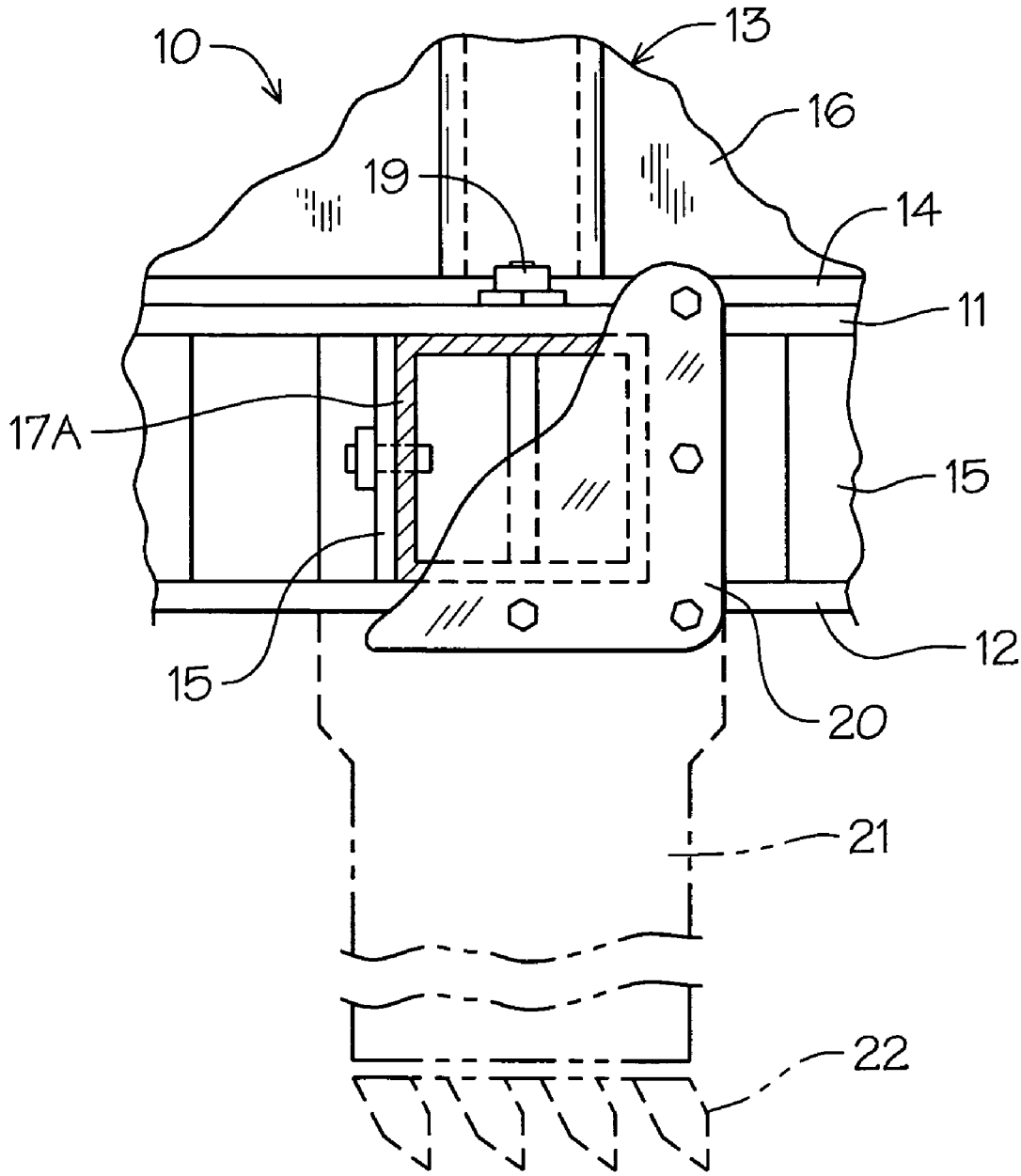
FIG. 4 is an enlarged side elevational view with portions broken away of a cutting blade of the invention.

Cutting blades 21 are secured to the mounting flanges 20 by multiple nut and bolt assemblies 19A with of each of the blades extending downwardly therefrom with a plurality of hardened cutting teeth 22 which are welded in longitudinally spaced relation to one another on each of the arms oppositely disposed ends thereof as best seen in FIG. 4 of the drawings.

The mounting arms 17A and 17B and 18A and 18B determines the effective cutting diameter of the attached cutting blades 20 when driven circularly in respect of the diameter of a manhole MH to be removed as seen graphically in FIG. 1 of the drawings and will be described in greater detail hereinafter.

It will be seen that the respective support frame disks 11 and 12 have oppositely disposed reduced edge diameter portions 11A and 12A above and below the respective mounting arms 17A, 17B and 18A and 18B to provide additional adjustment clearance therefore when fully retracted therebetween.

Figure 2:
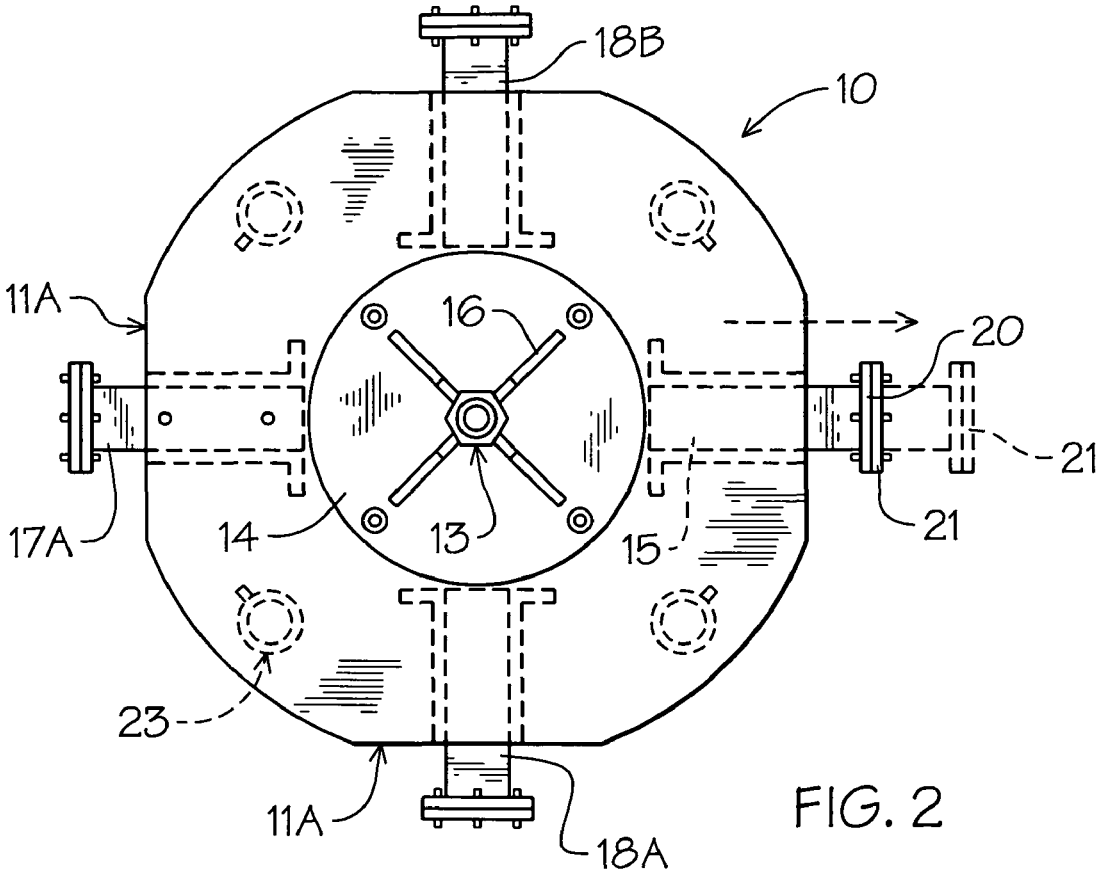
FIG. 2 is a top plan view thereof.
Figure 3:
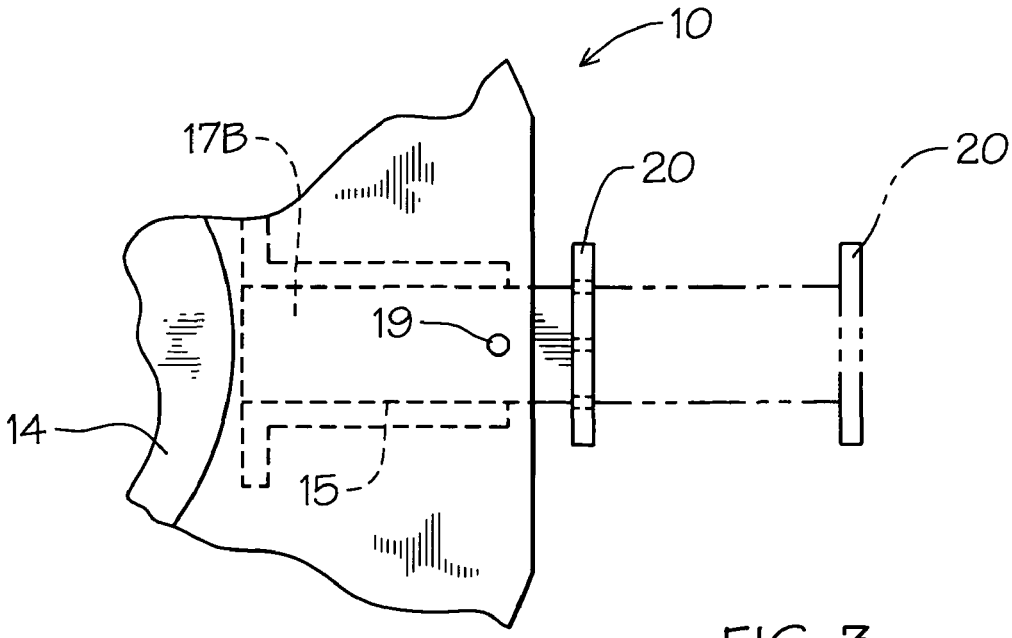
FIG. 3 is an enlarged partial top plan view of an adjustable cutting arm of the invention.

Referring to FIGS. 1 and 2 of the drawings, an integrated leg support assembly 23 for the manhole removal tool 10 when not in use can be seen having multiple annular leg receiving sockets 24 affixed between the frame disks 11 and 12. Each of the leg sockets 24 are aligned with access openings 25 in the disk 12 and evenly spaced between the respective adjustable cutting blade mounting arm pairs 17A, 17B and 18A and 18B hereinbefore described.

Tubular leg extension portions 26 of a reduced diameter are slidably secured within the respective sockets 24 by pins P through aligned receiving apertures A inwardly of the respective ends. Leg portion receiving platforms 27 are provided having a ground engagement end plate 28 secured on one end and are positioned and sized so as to telescopically receive the respective leg portions 26 which in combination provide a stable elevated integrated support structure for the manhole removal tool 10 when not in use.

Figure 5:
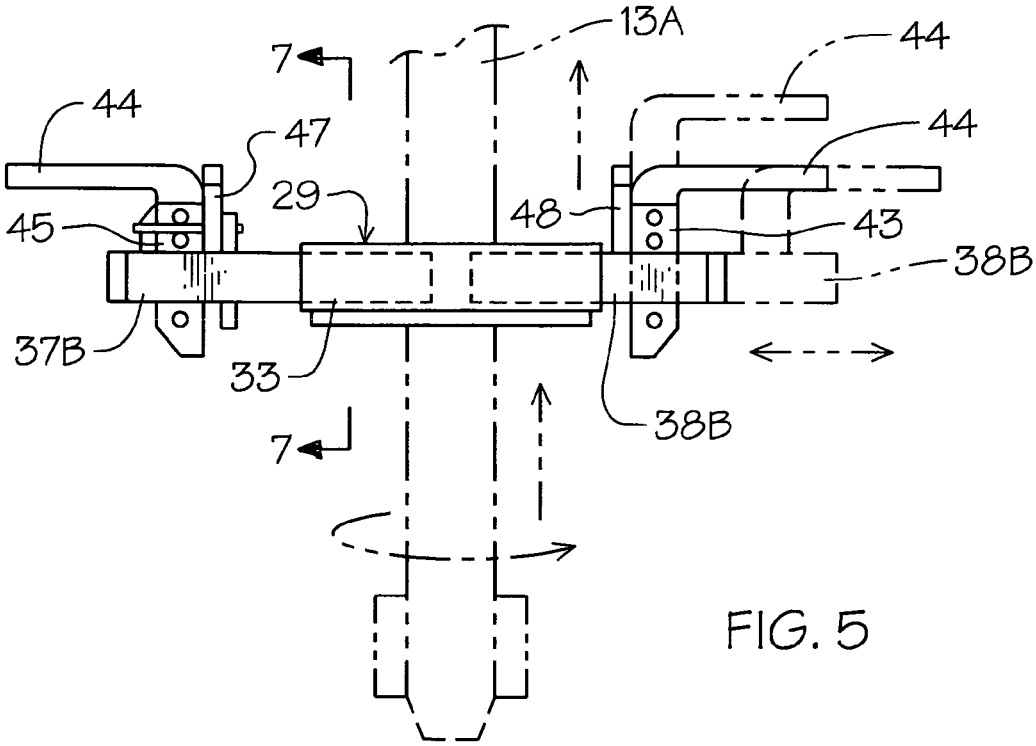
FIG. 5 is a side elevational view illustrating a locking alignment assembly.
Figure 6:
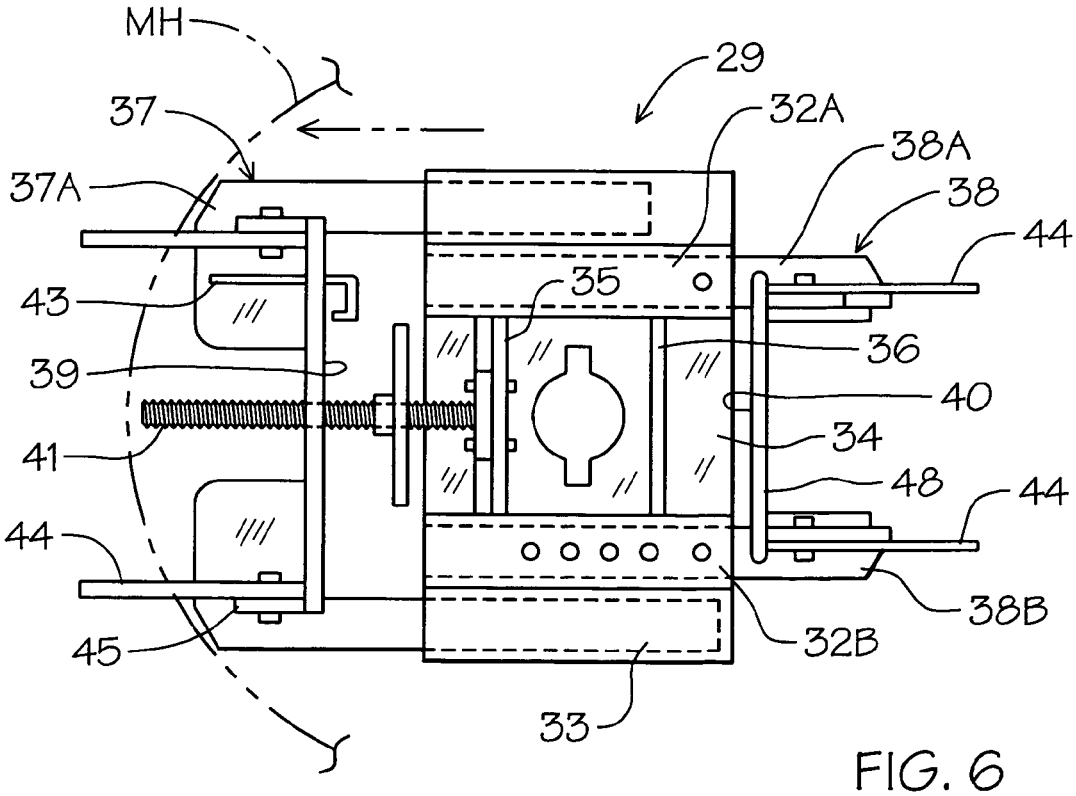
FIG. 6 is a top plan view of the locking alignment assembly.
Figure 7:
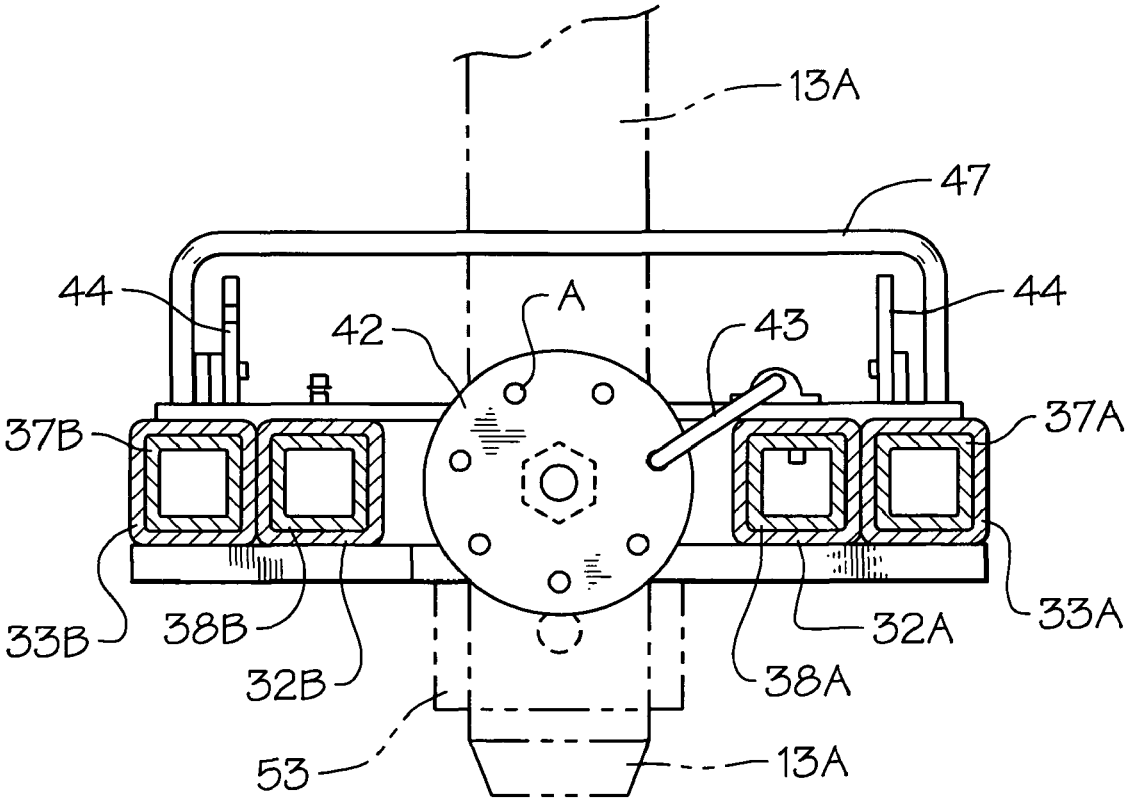
FIG. 7 is a cross-section view on lines 7-7 of FIG. 6.

Referring now to FIGS. 5, 6 and 7 of the drawings, an improved alignment locking assembly 29 can be seen that will be positioned to receive a main support shaft 30 of the drive shaft assembly 13.

The improved alignment and locking assembly 29 has a main support frame 31 with spaced parallel guide tube pairs 32 and 33 secured on a mounting platform 34 as best seen in FIG. 6 of the drawings. Apertured plates 35 and 36 extend between and are secured to the inner facing tubes 32A and 33A of the respective guide tube pairs 32 and 33.

A pair of movable manhole engagement arm assemblies 37 and 38 are comprises of tubular elements 37A, 37B, 38A and 38B respectively and are slidably disposed from within respective guide tube pairs 32 and 33 extending in oppositely disposed relation to one another.

Each pair of said tubular elements 37A, 37B, 38A and 38B are secured to one another adjacent their respective free ends by reinforcing plates 39 and 40 with the plate 39 having a central aperture therein. A threaded adjustment rod 41 extends from and is secured to the respective apertured base plate 39 by a separate mounting plate 39A. An indexed apertured adjustment disk 42 is threaded on the threaded rod 41 in spaced relation to the mounting plate 39A. The threaded rod 41 extends through an aperture A in the plate 39 so as to allow rotational adjustment of the disk 42 therealong so as to be positioned against the plate 39 advancing the arm assembly 37 from within the respective guide tube pair 33.

A locking disk engagement hook 43 is slidably mounted on the plate 39 for selective engagement through the apertured adjustment disk 42. This allows for longitudinal fixed repositioning of the arm assembly 37 from within the hereinbefore described guide tube pair 33 as indicated in broken lines in FIG. 6 of the drawings.

The corresponding movable manhole engagement arm assembly 38 has a plurality of longitudinally spaced apertures A therein for registration insertion of a locking pin P through a correspondingly selectively aligned aperture A in the guide tube pair 33 so as to effectively lock the engagement arm assembly 38 in a preselected extended position relative to the guide tube pairs 33 as best seen again in FIG. 6 of the drawings.

The tubular elements 37A, 37B, 38A and 38B of the respective arm assemblies 37 and 38 each have an upstanding adjustable L-shaped manhole engagement tab 44 positioned inwardly from the respective free ends, as best seen in FIGS. 5 and 6 of the drawings. The adjustable engagement tabs 44 are vertically adjustable in height by alignment with registering apertures in adjacent mounting plates 45 positioned on the respective tubular elements with nut and bolt fasteners F as seen in broken lines in FIG. 5 of the drawings.

The engagement tabs 44 extend outwardly with a surface engagement tab portion 45 beyond corresponding perimeter end surface S of the respective tubular elements 37A, 37B, 38A and 38B which are positioned for engagement with the inner surface of the manhole MH indicated graphically in broken lines in FIG. 6 of the drawings.

The reinforcement plates 39 and 40 that extend between respective arm assemblies are adjacent the engagement tabs 44 with additional support imparted to the respective arm pairs by reinforcement gusset pairs 46 as will be well known and understood by those skilled in the art. Additionally, handles 47 and 48 are provided which are secured to and between the respective tubular elements 37A, 37B, 38A and 38B for transport and positioning thereof.

In use, the manhole removal tool 10 of the invention is connected to a mobile power equipment (not shown) like a backhoe or Bobcat type loader having hydraulic power take-off which is well known and understood by those skilled in the art. The effective diameter of the cut to be made about the manhole is determined by the multiple cutting blades 20 which are adjusted using the locking nut and bolt assemblies 18 to advance and retract the respective mounting arms 17A, 17B, 18A and 18B in equal increments.

Figure 8:
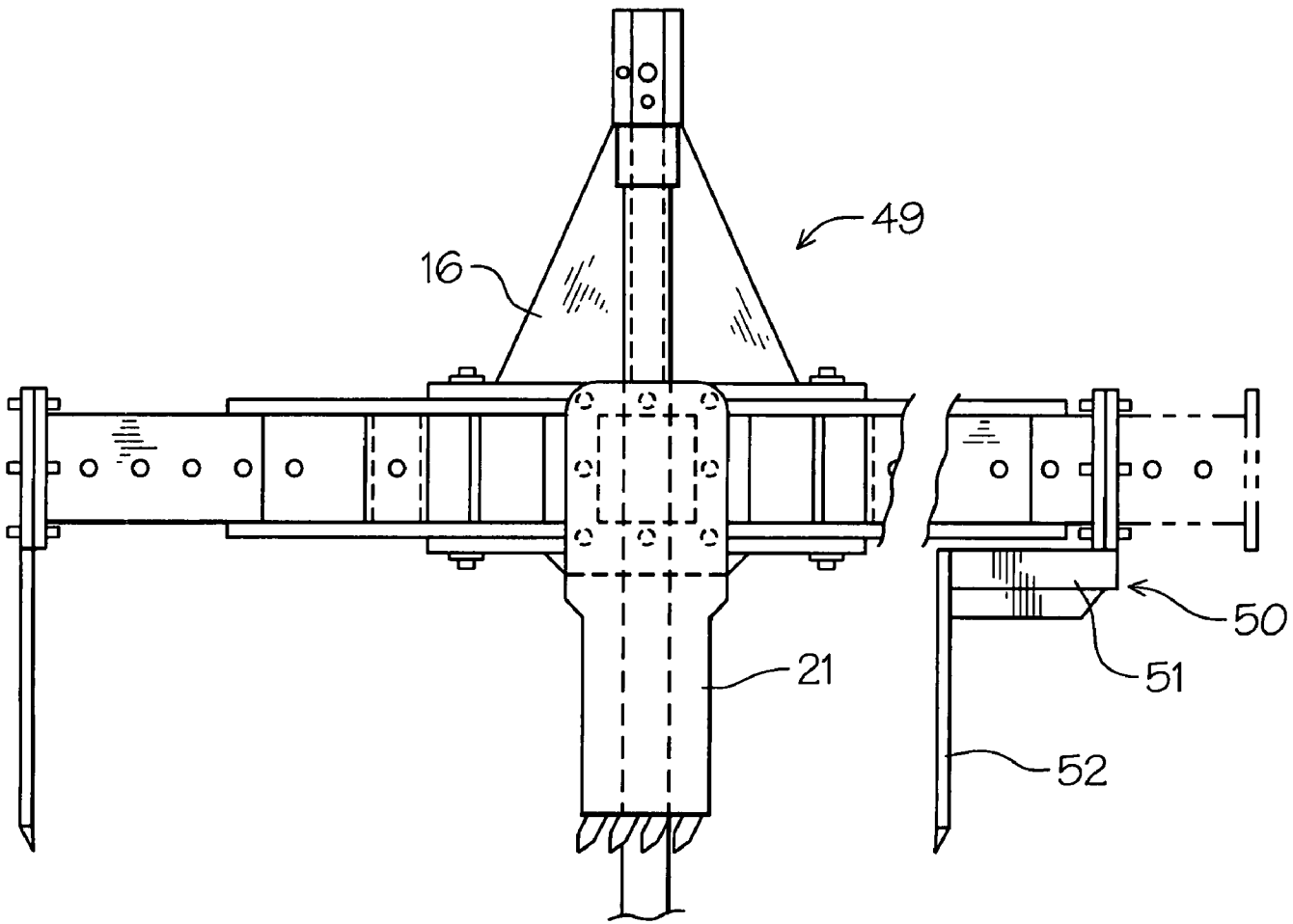
FIG. 8 is a side elevational view with a portion broken away of the manhole removal device with an alternate cutting blade and alternate locking alignment device.

Referring now to FIG. 8 of the drawings, an alternate offset cutting blade assembly 49 can be seen broken away in which the blade 50 has a right angular offset reinforced portion 51 with a depending surface engagement blade portion 52 extending therefrom. This allows for reduced diameter cuts which may be required in certain environments by reducing the effective diameter of the cutting blades by the proportional offset positioning of the blade 50 in association to that of the respective mounting arm.

In use, the alignment and locking assembly 29 is positioned within an open manhole MH with the movable manhole engagement arm assemblies 37 and 38 are adjusted and locked in place by advancement and rotation of the disk 42 on the corresponding threaded rod 41 with the corresponding perimeter end surfaces S of the arms frictionally engaging the inner surface of the manhole MH, as noted securing same thereto for removal once the surrounding pavement material has been continuously cut. The manhole removal tool is then positioned over the manhole MH and lowered with the drive shaft 13A extending through a key-shaped opening in the best base plate 39 of the locking and alignment assembly 37 as seen graphically in FIG. 1 of the drawings. The drive shaft 13A has multiple spaced key ways 52 therethrough with a selectively insertable single key tab 53.

As the manhole removal tool is rotated by the power take-off (not shown) the respective supporting disks 11 and 12 having the multiple extended cutter assemblies 20 thereon will engage and cut into the street surface SS defining a circular cut of a greater diameter than that of the manhole MH to a predetermined depth. The manhole removal tool 10 then removes the manhole MH and surrounding surface material by retracting the tool 10 and the engagement of the drive shaft key lift tab 53 in non-alignment with the key opening so as to lift the locking and alignment assembly 29, the manhole MH and associated material thereabout up and outwardly from the street leaving a uniform opening in the street which allows for rebuilding of the manhole MH to its proper height.

Figure 9:
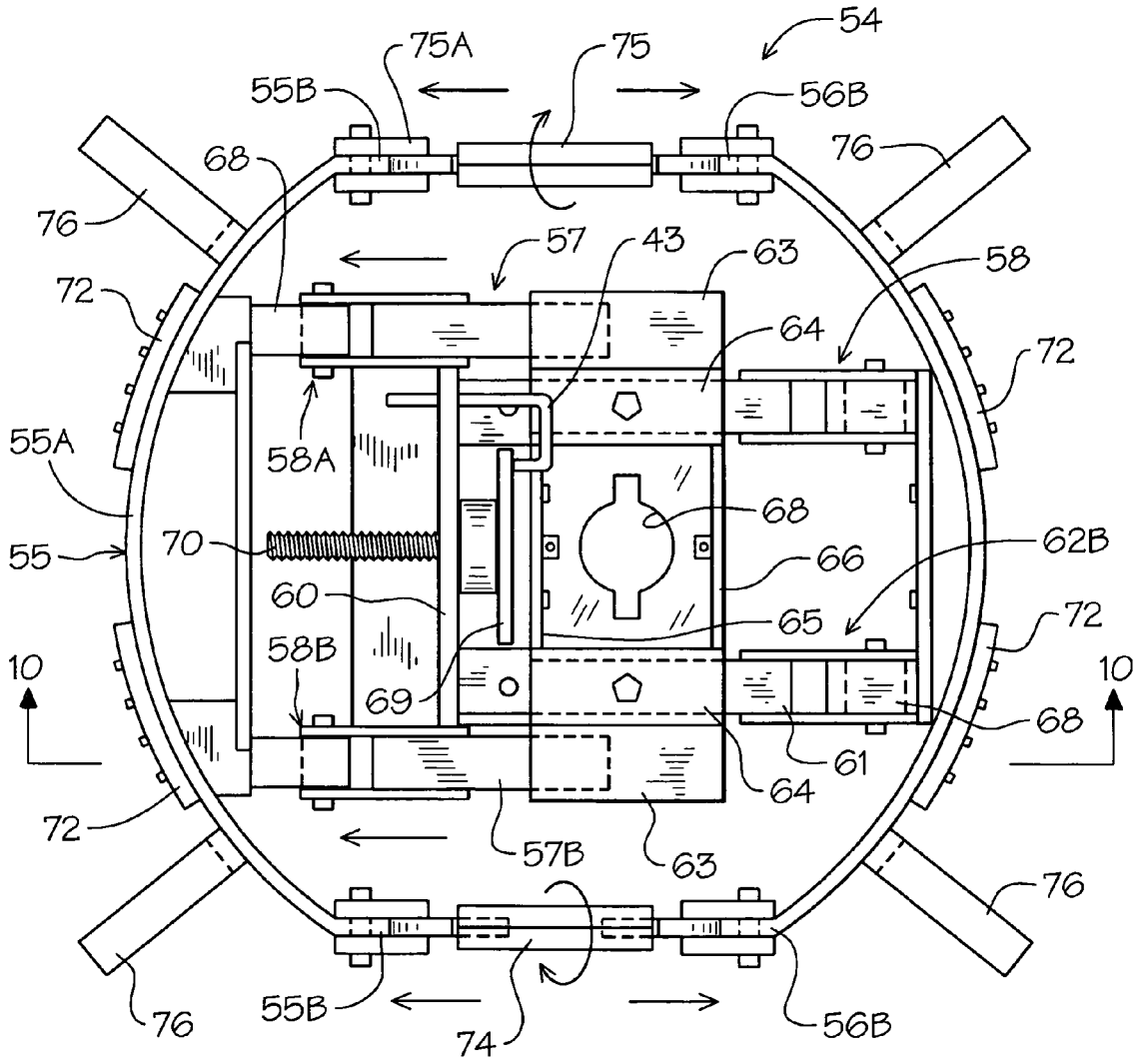
FIG. 9 is a top plan view of an alternate locking alignment assembly.
Figure 10:
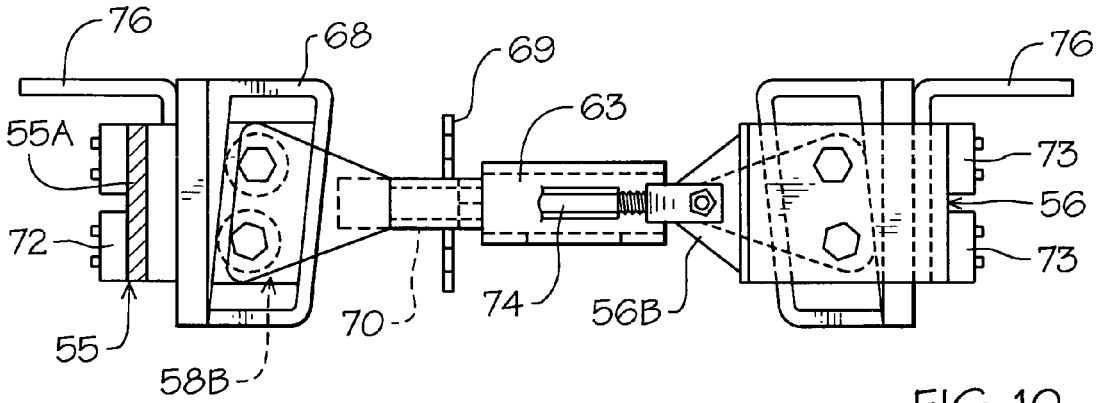
FIG. 10 is an enlarged side elevational view thereof with portions broken away.
Figure 11:
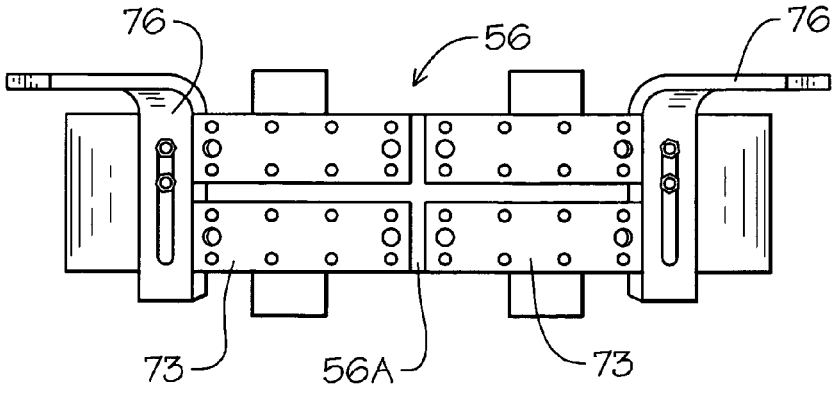
FIG. 11 is an enlarged end elevational view.

Referring now to FIGS. 9 and 10 of the drawings, an alternate alignment and locking assembly can be seen at 54 to address manhole configurations that require the alignment and locking assembly to be wedgeably engaged within the manhole casting.

A pair of oppositely disposed expanding arcuate engagement band assemblies 55 and 56 are adjustably secured to one another extending from the respective free ends of modified tubular extension arm assemblies 57 and 58 as will be described in detail hereinafter.

The arm assembly 57 has arm tubes 57A and 57B, each of which have cam roller mounting assemblies 58A and 58B on their free ends thereof. A transverse interconnecting support plate 59 with an upstanding apertured flange 60 extends between the tubes 57A and 57B adjacent the respective cam roller mounting assemblies 58A and 58B.

Correspondingly, the oppositely disposed arm assembly 58 has extending tubes 61A and 61B with their own cam roller mounting assemblies 62A and 62B extending from their respective free ends.

The arms assemblies 57 and 58 are slidably disposed from within corresponding spaced parallel guide tube pairs 63 and 64 secured to one another in spaced parallel relation with interconnecting ribs 65 and 66 extending therebetween defining a key way fitting 67 therebetween.

The respective cam roller mounting assemblies 57A, 57B, 62A and 62B have a U-shaped linkage arm 68 that is secured to the corresponding engagement band assemblies 55 and 56 so as to be vertically movable against the respective cam roller assemblies during engagement. The arm assembly 58 is movable from a first retracted position within the guide tube pairs 64 to a second fully extended position and locked by aligned fasteners F therethrough as best seen in FIG. 9 of the drawings.

The arm assembly 57 is incrementally advanced by engagement with an adjustment disk 69 which is rotatably positioned on a threaded rod 70 extending from the spacing rib 65 through the aperture in the flange 60 as hereinbefore described. It will thus be seen that by rotation of the disk 69, it will advance and engage the flange 60 incrementally extending the arm assembly 57 outwardly from its respective guide tube pairs 63 thus advancing the interlinked band assembly 55 against the inner surface of a manhole MH during use. Once adjustment has been achieved of the arm assembly 57 an offset indexing bar 71 slidably positioned in a bracket on the flange 60 can selectively engages and locks the adjustment disk 69 by registration with the aligned annularly spaced apertured therewithin.

Referring to FIG. 9 of the drawings, the manhole engagement bands 55 and 56 each have a curved center band 55A and 56A with apertured ends 55B and 56B. Each of the bands accordingly have a pair of arcuately spaced frictional engagement plates 72 and 73 secured thereon for direct engagement with the inside surface of the manhole MH. The curved center bands 55A and 56A are adjustably secured together by interengaging threaded adjustment couplings 74 and 75 having apertured bifurcated end brackets 74A and 75A on the respective apertured band free ends 55B and 56B by pivoted fasteners F therethrough. The adjustable combination allows for manhole insertion and adjustment retention therewithin by expansion compression of the bands by the respective arm assemblies 55 and 56 as hereinbefore described.

Multiple retainment positioning tabs 76 are mounted on the outer surface S of the respective bands 55A and 56A allowing the alternate alignment and locking assembly 54 to be positioned initially in the manhole MH before the extension of the respective arm assemblies and interlinked pivoting engagement band assemblies 55 and 56 securely lock the assembly in place within the manhole.

The wedging action will accommodate manhole configurations without internal flanges which would be normally engaged by the primary alignment and locking assembly tubular arm assemblies 37 and 38 as hereinbefore described.

It will be evident from the above description that the alternate alignment and locking assembly 54 will provide centering guidance to the improved manhole removal tool 10 in which the drive shaft 13A is extended through the key way 67 for guidance and then after surface cutting has occurred around the manhole MH, the repositioning of the drive shaft so as to engage the lift tab 53 within the key way 67 allows for removal of the manhole and associated cut-out of the street surface thereabout by elevation of the removal tool 10 by the mobile power equipment which it is attached (not shown) as previously described and disclosed.

It will thus be seen that a new and novel manhole removal tool 10 of the invention has been illustrated and described and it will be apparent to those skilled in the art that various changes and modifications will be made thereto without departing from the spirit of the invention. Therefore I claim:

The invention claimed is:

1. A manhole cutting and removing device comprising, a cutting assembly for being rotated about a central vertical axis to cut a circular slot about a manhole, said cutting assembly having a plurality of independent adjustable tubular mounting arms extending therefrom, cutting blades secured to and depending from said respective tubular mounting arms, a locking alignment and extraction assembly selectively and independently engaged within said manhole comprises, opposing spaced parallel engagement arm elements slidably extending from pairs of spaced parallel guide tubes, a drive shaft support and rotational engagement fitting extending from said cutting assembly, an extraction drive shaft extending from said shaft support through said locking, alignment and extraction assembly for selective engagement therewith and removal thereof, integrated independent elements support for said manhole removing device in and extending from said cutting assembly when not in use.

2. The manhole cutting and removing device set forth in claim 1 wherein said adjustable independent cutting blades are horizontally offset from said ends of said tubular mounting arms, a plurality of hardened steel teeth secured to respective free ends of each of said blades.

3. The manhole cutting and removing device set forth in claim 1 wherein said cutting assembly is of a reduced transverse diameter corresponding to opposing pairs of said tubular blade mounting arms extending therefrom.

4. The manhole cutting and removal device set forth in claim 1 wherein said drive shaft support and rotational engagement fitting has reinforcement gussets thereon.

5. The manhole cutting and removal device set forth in claim 1 wherein said extraction drive shaft has longitudinally spaced key ways and a selectively positionable key therein.

6. The manhole cutting and removing device set forth in claim 1 wherein said integrated independent support structure comprises, leg sockets in said cutting assembly, leg extensions and registerable leg receiving platforms selectively secured therein.

7. The manhole cutting and removing device set forth in claim 1 wherein some of said opposing engagement arm elements extending from said locking and alignment assembly have a registering thread rod and thrust locking nuts thereon for adjustable extension thereof.

8. The manhole cutting and removing device set forth in claim 1 wherein said locking alignment and extraction assembly is selectively engaged to said cutting assembly by key engagement of said drive and extraction shaft with a keyed opening in said locking alignment assembly.

9. The manhole cutting and removing device set forth in claim 1 wherein said locking alignment and extraction assembly further comprises, movable oppositely disposed arm assemblies from within guide tubes, arcuate engagement bands interengaged with said respective arm assemblies, an arm assembly advancement disk selectively engaged by rotation against one of said arm assemblies, a key way fitting between said guide tubes, means for selective adjustment of said engagement bands with one another.

10. The manhole cutting and removing device having the locking alignment and extraction assembly of claim 9 wherein said means for adjustably securing said engagement bands to one another comprises, longitudinally adjustable couplings interengaged therewith.

11. The manhole cutting and removing device having the locking alignment and extraction assembly of claim 9 wherein said adjustment bands have frictional engagement plates thereon, and upstanding position brackets extending therefrom.

12. The manhole cutting and removing device having the locking alignment and extraction assembly of claim 9 wherein said arm assemblies have cam rollers on their respective free ends with interengaged linkage arms secured to said engagement bands.

13. The manhole cutting and removing device having the locking alignment and extraction assembly of claim 9 wherein said remaining arm assembly is selectively extended from said respective guide tube pairs and locked in a selective first and second position by fasteners through said guide tubes and said select arm tubes of said arm assemblies.

* * * * *